United States Patent [19]

Ostrobrod

[11] Patent Number: 4,511,123

[45] Date of Patent: Apr. 16, 1985

[54] SAFETY DEVICE

[76] Inventor: Meyer Ostrobrod, 6723 Castor Ave., Philadelphia, Pa. 19149

[21] Appl. No.: 500,342

[22] Filed: Jun. 2, 1983

[51] Int. Cl.[3] ..... B66D 1/06; B66D 5/14

[52] U.S. Cl. ..... 254/364; 254/369; 254/376; 254/378; 182/234; 182/236; 242/107.3

[58] Field of Search ..... 254/369, 376, 218, 306, 254/320, 352, 375, 378; 242/107.3, 107.4 B; 182/75, 234, 236, 239; 188/181 A

[56] References Cited

U.S. PATENT DOCUMENTS

| | | | |
|---|---|---|---|
| 494,407 | 3/1893 | Bradley | 182/354 |
| 1,272,944 | 7/1918 | Green | 254/DIG. 14 |
| 2,518,934 | 8/1950 | Renner et al. | 182/354 X |
| 2,546,202 | 3/1951 | Trouin | 242/107.3 |
| 2,721,685 | 10/1955 | Frankel | 182/354 |
| 2,791,397 | 5/1957 | Coffman | 242/107.4 B X |
| 2,896,912 | 7/1959 | Faugier et al. | 242/107.3 X |
| 2,990,131 | 6/1961 | Carlsson | 182/239 X |
| 3,915,432 | 10/1975 | Bustamante | 182/239 |
| 3,985,342 | 10/1976 | Denman | 254/369 X |
| 4,008,881 | 2/1977 | Ross | 254/369 |
| 4,293,121 | 10/1981 | Wallin | 254/369 X |

FOREIGN PATENT DOCUMENTS

| | | | |
|---|---|---|---|
| 174970 | 7/1964 | U.S.S.R. | 182/236 |

*Primary Examiner*—Stuart S. Levy
*Assistant Examiner*—Joseph J. Hail, III
*Attorney, Agent, or Firm*—Duffield & Lehrer

[57] ABSTRACT

A safety device for preventing injuries to a worker as a result of a fall includes a housing which is intended to be supported at an elevated position where the worker is working and a cable which is adapted to be connected to a harness or belt worn by the worker. The housing includes a spring driven drum therein which normally keeps the cable wound thereon but which allows the same to be withdrawn slowly from the housing as more cable is needed by the worker. A centrifugally operated brake senses an initial quick withdrawal of the cable from the housing which results from the worker falling and stops further withdrawal therefrom to thereby prevent the worker from falling further. A hand operated winch mechanism carried by the housing allows a fellow worker to raise the fallen worker to safety.

4 Claims, 4 Drawing Figures

SAFETY DEVICE

BACKGROUND OF THE INVENTION

The present invention is directed toward a safety device and more particularly toward a safety device which is intended to prevent a worker who is working in a high place such as a bridge or the like from falling.

Safety devices of the class to which the present invention pertains and which protect a worker from injury or death caused by falling are known. These prior art devices are personal fall arrest systems and are used in conjunction with other components such as an anchoring means for the device and a body harness.

These known devices are comprised of a housing which is adapted to be suspended from an elevated structure. A rope or cable winding drum is rotatably mounted in the housing and a spiral spring drives the drum in a direction which continuously tends to wind the cable around the drum. A centrifugally operated brake mechanism responds to an initial fast rotation of the drum in the unwinding direction and brakes the rotation of the drum to prevent further unwinding thereof.

In use, these known safety devices are fixed to a structure such as a building, bridge or the like and the cable extending therefrom is fastened to a worker's belt or harness. Under normal working conditions, i.e. as the worker moves from one place to another and the rope is drawn in and out of the housing at a reasonable speed, the centrifugal brake is never engaged since the speed of rotation of the drum is relatively slow. Accordingly, the drum rotates freely and the rope is drawn out or wound on the drum freely. In the event of a fall, however, the rope is drawn out rapidly and the drum is then rotated at a high speed. As a result, the centrifugally operated brake is actuated preventing further rotation of the drum which stops the rope from being drawn out. This prevents injury or death to the worker which otherwise would occur as a result of the fall.

Former safety devices such as that described above are extremely useful and do prevent serious injury and death to workers. However, they all suffer from a common deficiency. When a worker has fallen and is being suspended by the rope from the safety device, additional lifting equipment is needed to lift the worker back up to safety.

Because of the elevated locations at which workers using such safety devices are normally working, it is often difficult and time consuming to get the necessary lifting equipment into place. In some situations, it may be possible for a worker to climb to safety. However, it is not uncommon for a worker to be slightly injured during the accident thereby making it difficult for him to lift himself to safety. A similar problem exists if the worker has fallen into a confined space such as a sewer, tank or the like.

SUMMARY OF THE INVENTION

The present invention is designed to overcome the deficiencies of the prior art described above. More particularly, it is an object of the present invention to provide a fall protection safety device which includes in combination therewith a rescue winch which allows a worker who has fallen to be raised again to a safe place in a fast and convenient manner.

The primary object of the present invention is accomplished by the use of a ratchet and pawl system in combination with a hand operated lever. The ratchet is fixed with the drum so as to rotate therewith and the pivotally mounted hand lever includes a driving pawl which engages and moves the drum each time the lever is moved. A second retaining pawl is mounted on the housing to retain the drum in position each time it is rotated. Spring means retain the pawls in a nonoperative position when the safety device is utilized for fall protection. These spring means allow the pawls to be moved to operative positions when the safety device is used as a rescue winch.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
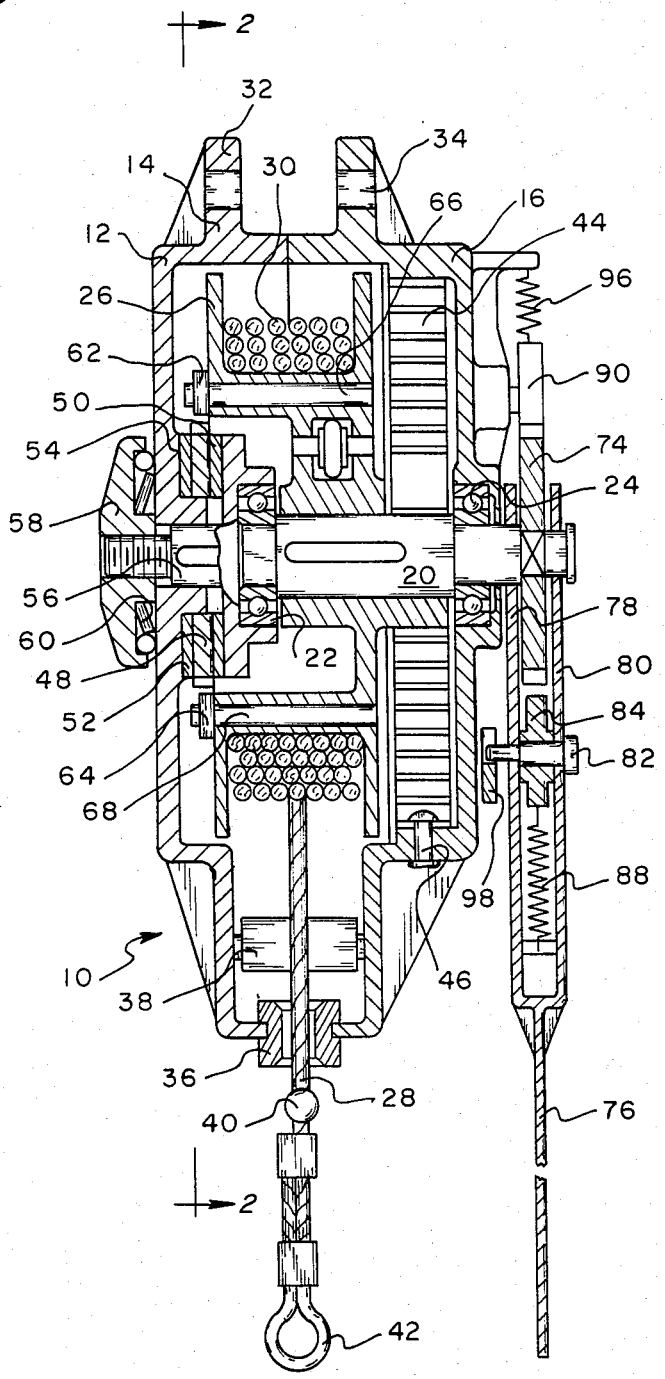
FIG. 1 is a sectional view of a safety device constructed in accordance with the principles of the present invention.

Referring now to the drawings in detail wherein like reference numerals have been used throughout the various figures to designate like elements, there is shown in FIG. 1 a cross-sectional view of a safety device constructed in accordance with the principles of the present invention and designated generally as 10. The safety device 10 is comprised essentially of a case or housing 12 formed by joining the two complementary housing portions 14 and 16. A plurality of bolts such as shown at 18 in FIGS. 2 and 3 maintain the two halves 14 and 16 securely together.

Rotatably mounted within the housing 12 is a horizontally arranged shaft 20. Bearings 22 and 24 allow the shaft 20 to rotate freely within the housing. Securely mounted on the shaft 20 so as to rotate therewith is a drum 26. A rope or cable 28 is wound about the drum 26 such as shown at 30.

The upper end of the housing 12 includes a support member 32 including an opening 34 which may be utilized to mount the entire device 10 to a support structure such as a bridge or the like. The lowermost portion of the housing 12 has an opening 36 therein which allows the cable 28 to pass therethrough after the same has been guided to the opening by guide roller 38. A stopper 40 carried by the rope 28 prevents the end of the rope from being drawn into the housing. Preferably, the rope also terminates in a hook, eye or the like 42 for connection to a harness worn by a worker.

Also located within the housing 12 is a spiral spring 44. The outermost spiral of the spring 44 is secured to the housing by a rivet or the like 46 as shown in FIG. 1. The innermost end (not shown) of the spring 44 is secured to the shaft 20. The spiral spring 44 maintains a continuous turning force on the shaft 20 and thus the drum 26 so that the cable 28 continuously tends to be wound up upon the drum 26.

Figure 2:
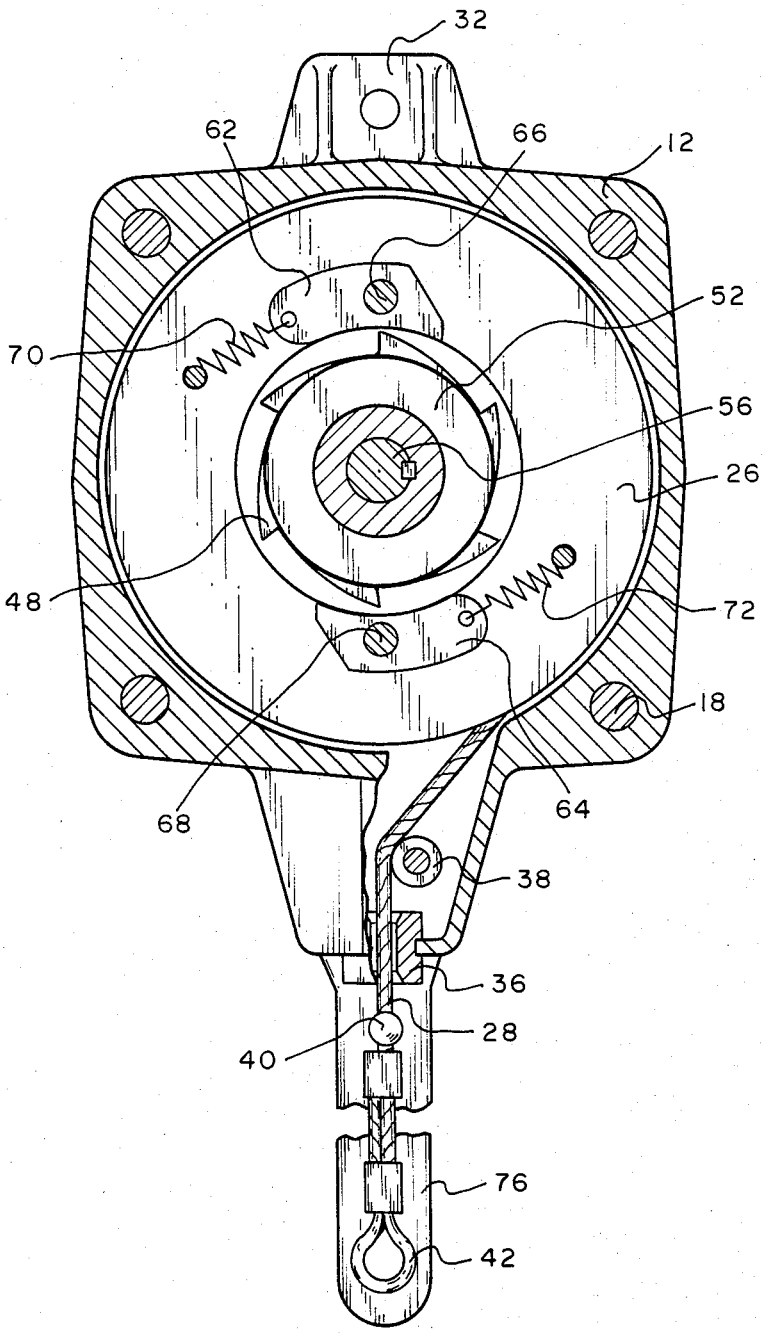
FIG. 2 is a sectional view taken along the line 2—2 of FIG. 1 and illustrating the centrifugal pawl and ratchet of the braking mechanism.

The centrifugally actuated brake mechanism is shown most clearly in FIGS. 1 and 2. The brake mechanism includes a ratchet 48 which is mounted for rotation but is clamped between brake pads or friction disks 50 and 52. The ratchet 48 and disks 50 and 52 are held between the inner wall of the housing part 14 and the undersurface 54 of the bolt 56. Nut 58 maintains the bolt in position and tension for the brake which is comprised of the friction disks 50 and 52 and the ratchet 48 is provided by spring 60.

A pair of pawls 62 and 64 are pivotally mounted on one of the outer surfaces of the drum 26 by pivot pins 66 and 68. These pawls are normally maintained in a non-operative position by springs 70 and 72. The pawls 62 and 64 normally rotate with the drum 26 and remain in the orientation with respect to the drum 26 shown in FIG. 2. However, should the drum rotate very quickly, centrifugal force causes the back end of each of the pawls 62 and 64 to move outwardly thereby causing the forward end of each pawl to engage the ratchet 48 and the entire drum 26 then slows down and eventually stops as a result of the forces of the friction disks 50 and 52.

The winch mechanism of the present invention will now be described with specific reference to FIGS. 1 and 3. Shaft 20 extends through the end wall of the housing portion 16 to the exterior of the housing 12. Ratchet 74 is securely fastened to the shaft 20 so as to rotate therewith. An elongated hand lever 76 has its bifurcated upper ends 78 and 80 rotatably mounted on the shaft 20 so as to freely move with respect thereto.

Pivotally mounted on axle 82 which extends between the bifurcated ends 78 and 80 is a driving pawl 84. Pawl 84 includes an arcuate slot 86 therein having a detent at each end thereof. Spring 88 has one end thereof secured to the lever and the other end engaging the slot 86 of the pawl 84. The spring 88 may be manually moved to either end of the slot 86 so that the pawl 84 will be maintained in the inoperative position shown in solid lines in FIG. 3 or the operative position shown in phantom wherein the pawl engages the ratchet 74.

Retaining pawl 90 is pivotally mounted directly on the housing 12 by pivot pin 92. Pawl 90 also includes an arcuate slot 94 having a detent at each end thereof which is similarly engaged by spring 96. As with pawl 84, pawl 90 can be maintained by the spring 96 in either the inoperative position shown in solid lines in FIG. 3 or the operative position shown in phantom wherein the pawl 90 engages the ratchet 74.

A locking lever 98 pivotally mounted to the housing 12 by pivot pin 100 is utilized to maintain the hand lever 76 in a locked position when the same is not being utilized. Locking lever 98 is located between the hand lever 76 and the housing 12 and is adapted to engage a pin extension of the axle 82. A spring 102 pulls the lever 98 upwardly but the upward movement is arrested by stop 104. The forward end 106 of the lever 98 is tapered so that it will be cammed downwardly as the hand lever 76 is moved toward the lever 98 until the pin 82 locks in place in the recess 108.

The safety device of the present invention operates in the following manner. Utilizing openings 34 at the top end of the housing 12, the device is first suspended from a suitable support structure. The cable is then connected to a worker's belt or harness through the use of the hook or eyelet 42.

As the worker moves away from the housing, the cable 28 is drawn out thereby turning drum 26 in a direction to tighten the spiral spring 44. Accordingly, when the worker moves nearer to the housing, the drum 26 is turned in a direction to wind the cable 28 by the restoring force of the spiral spring 44 and the slackened rope is wound up. As a result, no slack is ever left in the rope 28 which could be an obstacle to the worker. The speed of rotation of the drum 26 is relatively small and the pawls 62 and 64 are maintained in their normal inoperative positions by springs 70 and 72. In the meantime, pawls 84 and 90 are also maintained by springs 88 and 96 in their inoperative position, i.e. disconnected from the ratchet 74 and the locking lever 98 maintains the hand lever 76 in its locked position.

In the event that the worker falls by mistake, the cable 28 is drawn out rapidly. Since the drum 26 is also rotated rapidly, pawls 62 and 64 overcome the force of springs 70 and 72 by the action of centrifugal force and engage the ratchet 48 of the braking mechanism. The rotation of the drum 26 is stopped and the force of the worker's weight is absorbed by the friction brake.

Figure 3:
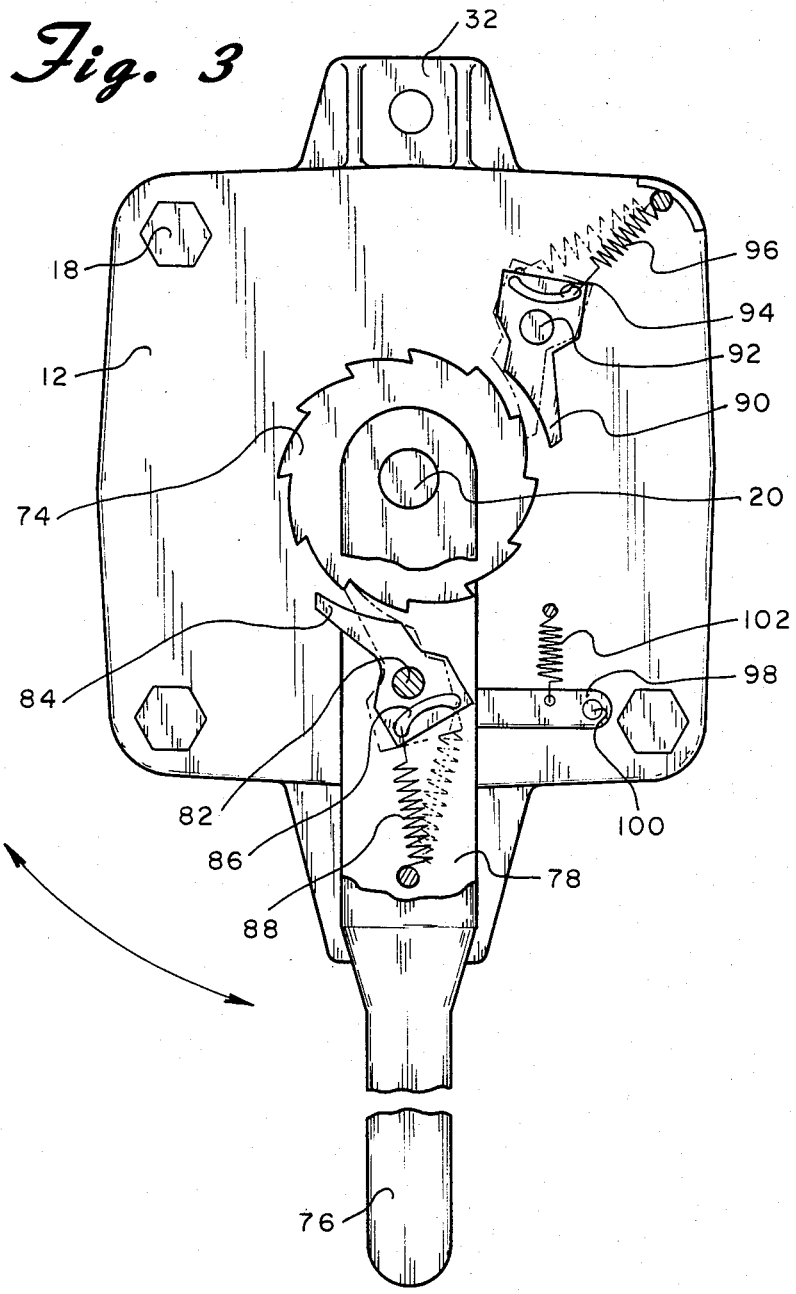
FIG. 3 is an end view taken from the right side of FIG. 1 with portions broken away for clarity and showing the details of the rescue winch.
Figure 4:
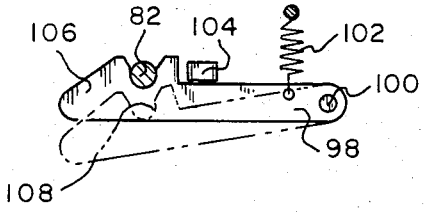
FIG. 4 is an illustration of the lever locking device.

In order to lift the fallen worker back up to safety, a co-worker first manually moves the springs 88 and 96 along the arcuate slots 86 and 94, respectively, so that the pawls 84 and 90 will assume the position shown in phantom in FIG. 3 wherein they each engage the ratchet 74. The locking lever 98 is then moved downwardly so that the hand lever 76 may be moved out of the locked position, i.e. to the left as shown in FIG. 3.

The hand lever 76 is then oscillated up and down as shown by the arrow in FIG. 3. Each time the hand lever 76 is moved upwardly, pawl 84 engages ratchet 74 and rotates the same approximately ninety degrees in a direction which winds the cable about the drum 26 thereby lifting the worker. The ratchet 74 and drum 26 are then maintained in this position by ratchet 90 as the lever 76 is moved downwardly to begin the upward cycle again. This is repeated until the worker has been raised to safety. At this time, the hand lever 76 is moved entirely to its downward position wherein it is again locked in place by the locking lever 94.

The present invention may be embodied in other specific forms without departing from the spirit or essential attributes thereof and accordingly, reference should be made to the appended claims rather than to the foregoing specification as indicating the scope of the invention.

I claim:

1. A safety device comprising:

a housing including support means adjacent the upper end and a cable outlet adjacent the lower end thereof;

a drum within said housing, said drum being secured to a shaft which is coaxial therewith and which shaft is mounted for rotation;

a cable adapted to be wound around said drum, one end of said cable extending through said outlet and being adapted to be connected to a harness worn by a workman;

a spiral spring coaxially arranged with respect to said shaft, one end of said spring being fixed to said housing and the other end being attached to said shaft whereby said spring acts to rotate said drum to wind the cable thereon whenever said cable is withdrawn from said housing;

braking means mounted within said housing and being coaxially arranged with respect to said shaft, said braking means including a braking ratchet;

a centrifugally operated braking pawl mounted for rotation with said drum, spring means biasing said braking pawl into an inoperative position wherein it does not engage said braking ratchet so that said drum can rotate freely to allow said cable to be freely drawn into or out of said housing through said cable outlet, said braking pawl being automatically movable into an operative position at a predetermined drum speed wherein it engages said braking ratchet to activate said braking means which initially slows said drum down thereby slowing down the withdrawal of said cable from said housing and which braking means then fully stops the withdrawal of said cable further including means mounted on said housing for locking said manually operated lever against pivotal movement;

means carried by said housing for manually rewinding said cable into said drum, said rewinding means including a rewinding ratchet fixedly secured directly to said shaft and a manually operated lever pivotally mounted on said housing, said lever carrying a rewinding pawl which is movable between an inoperative position and an operative position wherein said rewinding pawl engages said rewinding ratchet to rewind said cable onto said drum when said lever is manually operated.

2. The safety device as claimed in claim 1 including a locking pawl mounted on said housing and being adapted to engage said rewinding ratchet to prevent unwinding of said drum.

3. The safety device as claimed in claim 1 wherein said locking means includes a spring biased locking lever having a recess therein which engages a portion of the manually operated lever.

4. The safety device as claimed in claim 3 wherein said locking lever includes a cam surface thereon which cooperates with said manually operated lever so that when said manually operated lever is moved toward said locking lever, the locking lever is moved so that said recess can engage the said portion of said manually operated lever to lock the same against movement.

* * * * *